US011355092B1

(12) United States Patent
Kao et al.

(10) Patent No.: US 11,355,092 B1
(45) Date of Patent: Jun. 7, 2022

(54) STRIKE PAD

(71) Applicant: RELIANCE INTERNATIONAL CORP., Taipei (TW)

(72) Inventors: Han-Chun Kao, Taipei (TW); Tsung-Lun Hsieh, Taipei (TW)

(73) Assignee: RELIANCE INTERNATIONAL CORP., Taipei (TW)

( * ) Notice: Subject to any disclaimer, the term of this patent is extended or adjusted under 35 U.S.C. 154(b) by 0 days.

(21) Appl. No.: 17/342,534

(22) Filed: Jun. 8, 2021

(30) Foreign Application Priority Data

Apr. 9, 2021 (TW) ..... 11020396.8

(51) Int. Cl.
*G10D 13/03* (2020.01)
*G10D 13/24* (2020.01)

(52) U.S. Cl.
CPC ..... *G10D 13/03* (2020.02); *G10D 13/24* (2020.02)

(58) Field of Classification Search
CPC ..... G10D 13/03; G10D 13/24
See application file for complete search history.

(56) References Cited

U.S. PATENT DOCUMENTS

| | | | | |
|---|---|---|---|---|
| 6,686,526 | B2 * | 2/2004 | Ezbicki | G10D 13/03 84/411 R |
| 7,638,701 | B2 * | 12/2009 | May, Jr. | G10D 13/03 84/411 R |
| 7,723,593 | B1 * | 5/2010 | Prentice | G10D 13/03 84/411 R |
| 7,812,235 | B2 * | 10/2010 | May | G10D 13/03 84/411 R |
| 10,388,262 | B2 * | 8/2019 | Zhong | G10H 3/143 |
| 2020/0074970 | A1 * | 3/2020 | Suitor | G10H 3/188 |

* cited by examiner

*Primary Examiner* — Robert W Horn

(57) ABSTRACT

A strike pad includes a strike layer, a magnet layer, a metal soft sheet, and a base. The magnet layer is provided on a bottom of the strike layer, the metal soft sheet is provided on a top of the base, and then a magnet layer the bottom is magnetically attached to the top of a metal soft sheet. In the above technical solution, a magnet layer is set on the bottom of a strike layer, and a metal soft sheet is set on the top of a base. The user first puts a base on a fixed surface, and then holds a strike layer, facing the magnet layer to a metal. The soft sheet makes the magnet layer adsorb on a metal soft sheet to realize the assembly between the strike layer and a fixing seat; when disassembling, the magnet layer and the metal soft sheet can be separated.

6 Claims, 1 Drawing Sheet

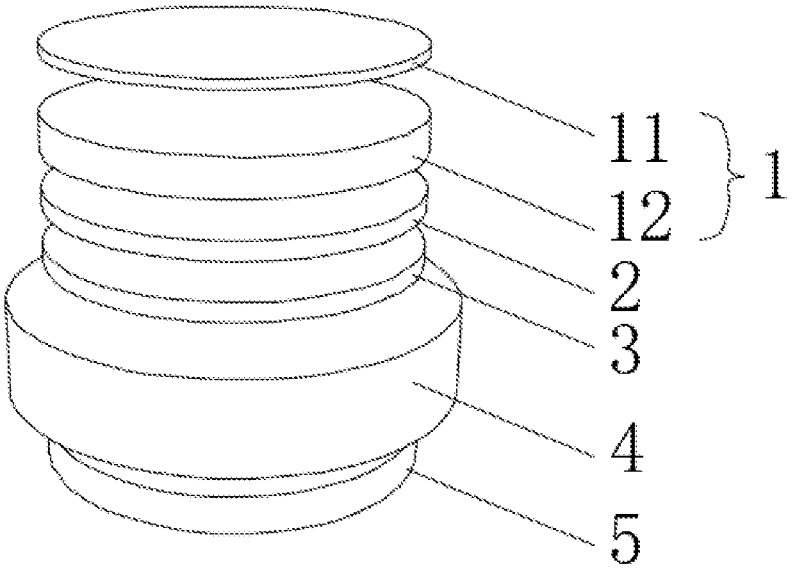
11
12
1
2
3
4
5

STRIKE PAD

CROSS REFERENCE TO RELATED APPLICATIONS

The present application claims the benefit of Taiwanese Patent Application No. 110203968 filed on Apr. 9, 2021, the contents of which are incorporated herein by reference in their entirety.

BACKGROUND OF THE INVENTION

1. Field of the Invention

The present disclosure relates to the field of drum equipment, especially a strike pad.

2. Description of the Related Art

The drum is a percussion instrument. A sturdy and generally barrel-shaped drum body, one or both sides of which are covered with a stretched film. The drum can be struck with hands or with a pestle. Drums are an important instrument in Asian traditional music and in modern music. Some bands are composed of percussion instruments that are entirely based on drums.

The size of the drum is relatively large, and beginners can use the strike pad to practice when they practice drumming. The existing strike pad includes a base and a strike layer, and has the following shortcomings:

The skin of the strike layer of different materials will affect the feel of the strike, and the base and the strike layer are not easy to disassemble, which causes users to purchase several different types of strike pads to obtain a strike pad that meets the expected feel. Increase the cost of consumers to a certain extent.

BRIEF SUMMARY OF THE INVENTION

Therefore, it is necessary to provide a strike pad to solve the problem of difficult disassembly between the base and the strike layer.

The present provides a strike pad, which includes a strike layer, a magnet layer, a metal soft sheet, and a base. A bottom of the strike layer is provided with the magnet layer, a top of the base is provided with the metal soft sheet, and the bottom of the magnet layer is magnetically connected to the top of the metal soft sheet.

In one embodiment of the present invention, the strike pad also includes an anti-slip layer, the bottom of the base is provided with the anti-slip layer, the anti-slip layer is used to increase a friction between the base and a fixed surface.

In one embodiment of the present invention, the anti-slip layer is a striking surface with different hand feelings.

In one embodiment of the present invention, the strike layer includes a rubber layer and a drum skin layer; the drum skin layer is arranged on the top of the rubber layer, the rubber layer is arranged on the top of the magnet layer.

In one embodiment of the present invention, the rubber layer can be replaced with a silicone layer or a foam layer.

In one embodiment of the present invention, a cross-section of the strike layer is circular, or the cross-section of the buffer layer is circular, or the cross-section of the magnet layer is circular, or the cross-section of the metal soft sheet is circular, or the base the cross-section is circular.

In one embodiment of the present invention, in the strike pad provided by the present, the bottom of the strike layer is provided with a magnet layer, and the top of the base is provided with a metal film. The user needs to set the base on the fixed surface (such as a desktop, ground, wall, etc.). Then hold the strike layer, and place the magnet layer against the metal soft sheet and make the magnet layer adsorb on the metal soft sheet to realize the assembly between the strike layer and the fixing seat; When disassembling, just separate the magnet layer and the metal soft sheet. Strike pad can quickly replace different strike layers, which improves the practicality of strike pad. Strike pad has good convenience and is easy to carry.

BRIEF DESCRIPTION OF THE DRAWINGS

The sole FIGURE is a structure diagram of the present invention.

DETAILED DESCRIPTION OF THE INVENTION

Please refer to the sole FIGURE, which is a structure diagram of the present invention, The present provides a strike pad, which includes a strike layer 1, a magnet layer 2, a soft metal sheet 3, and a base 4. A bottom of the strike layer 1 is provided with the magnet layer 2, and a top of the base 4 is provided with the metal soft sheet 3. The metal soft sheet is magnetic, and the bottom of the magnet layer 2 is magnetically connected to the top of the metal soft sheet 3. It should be noted that the magnet layer is pasted on the strike layer, and the metal film is pasted on the base.

The bottom of the strike layer is provided with a magnet layer, and the top of the base is provided with a metal film. The user needs to set the base on a fixed surface (such as a desktop, ground, wall, etc.). Then hold the strike layer, and place the magnet layer against the metal soft sheet and make the magnet layer adsorb on the metal soft sheet to realize the assembly between the strike layer and the fixing seat; when disassembling, just separate the magnet layer and the metal soft sheet. Strike pad can quickly replace different strike layers, which improves the practicality of strike pad. Strike pad has good convenience and is easy to carry.

In one embodiment of the present invention, the base 4 is arranged on the fixed surface to prevent a fixed seat from sliding on the fixed surface. The strike pad also includes an anti-slip layer 5. The anti-slip layer 5 is provided at the bottom of the base 4, and the anti-slip layer 5 is used to increase a friction between the base 4 and the fixing surface. The bottom of the anti-slip layer 5 has a pattern, and the friction is increased by roughness. Or the anti-slip layer 5 is a material with a relatively large friction coefficient.

In one embodiment of the present invention, the strike layer 1 includes a rubber layer 12 and a drum skin layer 11. The drum skin layer 11 is provided on the top of the rubber layer 12. The rubber layer 12 is arranged on the top of the magnet layer 2, and the rubber layer 12 has a buffering effect. It should be noted that the magnet layer is pasted on the rubber layer.

In one embodiment of the present invention, the drum skin layer 11 can be tennis cloth, drum skin, etc. The drum skin layer 11 of different materials can bring different slap feels, and the choice of the material of the drum skin layer 11 is determined according to the needs of the user. The present invention adapts various drum skin layer 11 through a base 4, which not only improves the market competitiveness of strike pad but also reduces the shopping cost of consumers.

In some of the embodiment of the present invention, the rubber layer 12 can be replaced with a silicone layer or a foam layer, and according to their functions, the rubber layer 12, the silicone layer and the foam layer can also be used as a buffer layer. The rubber layer 12, the silicone layer, and the foam layer can also make the tapping sound smaller, and will not cause sound pollution to the people around.

A cross-section of the strike layer 11 is circular, or the cross-section of the buffer layer 12 is circular, or the cross-section of the magnet layer 2 is circular, or the cross-section of the metal soft sheet 3 is circular, or the base 4 of the cross-section is circular. Certainly, the shape of a cross-section of the drum skin layer 11, the rubber layer 12, the magnet layer 2, the metal soft sheet 3, and the base 4 can also be rectangular, pentagonal, hexagonal and other geometric FIGURES, but is not limited thereto.

In one embodiment of the present invention, the base 4 is a wooden base or a plastic base, but it is not limited thereto. The base has a certain hardness to support the upper strike layer and the metal soft sheet, which makes the strike pad have better stability.

In one embodiment of the present invention, the anti-slip layer 5 is a striking surface with different hand feelings.

In one embodiment of the present invention, the positions of the magnet layer 2 and the metal soft sheet 3 can be replaced with each other.

It should be noted that, although the foregoing embodiments have been described in this article, this does not limit the scope of patent protection of the present. Therefore, based on the present's innovative ideas, changes and modifications to this embodiment of this article, or equivalent structure or equivalent process transformations made using the present specification and drawings, directly or indirectly apply the above technical solutions to other related technical fields are included in the protection scope of the present.

What is claimed is:

1. A strike pad, including a strike layer, a magnet layer, a metal soft sheet, and a base, a bottom of the strike layer is provided with the magnet layer, a top of the base is provided with the metal soft sheet, and the bottom of the magnet layer is magnetically connected to the top of the metal soft sheet.

2. The strike pad as described in claim 1, wherein the strike pad also includes an anti-slip layer, the bottom of the base is provided with the anti-slip layer, the anti-slip layer is used to increase a friction between the base and a fixed surface.

3. The strike pad as described in claim 2, wherein the anti-slip layer is a striking surface with different hand feelings.

4. The strike pad as described in claim 1, wherein the strike layer includes a rubber layer and a drum skin layer; the drum skin layer is arranged on the top of the rubber layer, the rubber layer is arranged on the top of the magnet layer.

5. The strike pad as described in claim 4, wherein the rubber layer can be replaced with a silicone layer or a foam layer.

6. The strike pad as described in claim 1, wherein a cross-section of the strike layer is circular, or the cross-section of a buffer layer is circular, or the cross-section of the magnet layer is circular, or the cross-section of the metal soft sheet is circular, or the base the cross-section is circular.

* * * * *